US009096053B2

(12) United States Patent
Terkel et al.

(10) Patent No.: US 9,096,053 B2
(45) Date of Patent: Aug. 4, 2015

(54) METHOD FOR SORTING MAIL PIECES ON A PRINTING PRESS

(75) Inventors: Donald S. Terkel, Waukesha, WI (US); Kenneth J. Frohmader, West Bend, WI (US); Kip Rohde, Pewaukee, WI (US); Gary J. Schermer, Waukesha, WI (US)

(73) Assignee: Quad/Graphics, Inc., Sussex, WI (US)

( * ) Notice: Subject to any disclaimer, the term of this patent is extended or adjusted under 35 U.S.C. 154(b) by 541 days.

(21) Appl. No.: 13/240,403

(22) Filed: Sep. 22, 2011

(65) Prior Publication Data

US 2013/0074721 A1 Mar. 28, 2013

(51) Int. Cl.

| | |
|---|---|
| ***B41F 13/64*** | (2006.01) |
| ***B41F 13/46*** | (2006.01) |
| ***B41F 19/00*** | (2006.01) |
| ***B41F 13/60*** | (2006.01) |

(52) U.S. Cl.

CPC ..... *B41F 19/008* (2013.01); *B41F 13/60* (2013.01); *B41F 13/64* (2013.01); *B41F 19/007* (2013.01)

(58) Field of Classification Search

CPC ..... B41F 13/54; B41F 13/56; B41F 17/00; B41F 19/00; B41F 13/46; B41F 13/60; B41F 13/64; B41F 13/70; B41F 19/007; B41F 19/008; B65H 2301/4311; B65B 11/48

USPC ..... 101/226, 227, 483, 492; 270/1.02, 4, 270/10, 11, 20.1, 21.1

See application file for complete search history.

(56) References Cited

U.S. PATENT DOCUMENTS

| | | | | |
|---|---|---|---|---|
| 4,694,631 | A * | 9/1987 | Gunther, Jr. | 53/55 |
| 5,029,832 | A | 7/1991 | Orsinger et al. | |
| 5,107,656 | A * | 4/1992 | Katz et al. | 53/131.4 |
| 5,211,384 | A | 5/1993 | Orsinger et al. | |
| 5,524,421 | A * | 6/1996 | Nauheimer et al. | 53/460 |
| 5,640,831 | A * | 6/1997 | Harrod et al. | 53/429 |
| 5,913,656 | A * | 6/1999 | Collins | 414/801 |
| 6,347,260 | B1 * | 2/2002 | Graushar et al. | 700/223 |
| 6,682,067 | B1 | 1/2004 | Keane et al. | |
| 7,982,156 | B2 * | 7/2011 | Burns et al. | 209/584 |
| 2006/0016738 | A1 * | 1/2006 | Norris et al. | 209/584 |

OTHER PUBLICATIONS

Graphic Resource, Inc., Davey Teague, "News from Graphic Resource Inc.", Sep. 1, 2011.
Graphic Resource, Inc., "About Us", Oct. 3, 2009.

* cited by examiner

*Primary Examiner* — Leslie J Evanisko
(74) *Attorney, Agent, or Firm* — Michael Best & Friedrich LLP

(57) ABSTRACT

A method includes creating a stream of uniquely-addressed mail pieces on a web offset press by printing on sections of a web, separating the sections of the web, and printing unique address information on each section of the press-printed material. The unique address is printed by a variable printer according to a mail file of intended recipients. The stream of uniquely-addressed mail pieces is conveyed in a shingled formation. An on-press conversion of the stream of uniquely-addressed mail pieces into a plurality of batches of stacked mail pieces is performed, each batch containing only mail pieces belonging to a common mail delivery group. The on-press conversion includes controlling via the controller the creation of batch separation points among the mail pieces according to the mail file, conveying the stream of mail pieces in the shingled formation into a stacking device, and stacking the mail pieces with the stacking device.

20 Claims, 11 Drawing Sheets

METHOD FOR SORTING MAIL PIECES ON A PRINTING PRESS

BACKGROUND

The present invention relates to the sorting of mail pieces on a printing press.

A prior art sorting method is described with reference to FIG. 1. On an offset web press, a web 10 of printable material is printed with static content by press rollers 11 (e.g., an offset or blanket cylinder and an impression cylinder) to generate a printed web 10' having sequential sections later cut into individual mail pieces 12. In other words, the section of the web 10 corresponding to each mail piece 12 is printed with the same set of text and/or graphics by the press rollers 11. One or more ink jet printers 14 are provided and controlled by a controller 16 to print variable information, which may include, for example, a recipient's address on each section of the printed web 10' corresponding to an individual mail piece 12. A slitter unit 17 can slit the printed web 10' longitudinally along the length to provide two or more parallel web sections. Furthermore, a cutter unit 18, such as a rotary cutter, can convert the printed web 10' into individual mail pieces 12 by cutting the printed web 10' at various locations along the web.

In some circumstances, the mail pieces 12 produced on the press are enveloped mail pieces (i.e., the mail pieces 12 comprise both a printed insert and an envelope). For example, a web 10*a* of envelope stock (which can be printed by additional press rollers 11*a* to form a printed envelope web 10*a*') can be fed to the slitter unit 17 along with the first printed web 10'. The envelope stock is either printed with variable information (e.g., recipient's address) at an ink jet printer 20 as directed by the controller 16 or punctured with a die to form windows in the envelope stock, allowing variable print on the portions of the first printed web 10' to show through when those portions of the first printed web 10' are received in the envelopes. If enveloped on press, envelopes are built around individual portions of the first printed web 10' at a folder 22 between the slitter unit 17 and the cutter unit 18. The folder 22 can include one or more die cutters (not shown) for cutting the printed web 10' into discrete parts or sections. A folding mechanism in the folder 22 wraps the printed envelope web 10*a*' around the first printed web 10', or the discrete sections cut from the web, and the cutter unit 18 cuts the printed envelope web 10*a*' into discrete parts or sections to form the discrete mail pieces 12.

Regardless of whether they are enveloped, the mail pieces 12 are assembled into shingled streams (a portion of each mail piece 12 rests on the adjacent piece 12) and transported by delivery tables 26 made up of multiple conveyors run at different speeds. As shown in FIG. 1, the shingled streams of mail pieces 12 are sent to end-of-line conveyors 30 where a team of workers 32 handles and removes the mail pieces 12. A pneumatically-actuated finger 34 along each delivery table 26 can be actuated by the controller 16 to identify batches of mail pieces 12 by creating increased gaps between predetermined adjacent mail pieces 12 of each shingled stream. These increased gaps identify bundle and tray breaks for the workers 32 that stack and remove the mail pieces 12. Bundle breaks identify the end of a mail group of mail pieces 12 to be associated together in a bundle 36 (e.g., a group of mail pieces 12, smaller than a standard-sized mail tray 40, belonging to a certain zip code or zip code grouping, postal service carrier route, etc.). Tray breaks identify the end of a group of mail pieces 12 that will fit into a single mail tray 40. The bundle and tray breaks for controlling the fingers 34 may be triggered by the controller 16 according to the same mail file that controls the address printing at the variable printer(s) 14, 20.

Even with the controller-operated fingers 34 marking bundle and tray breaks, multiple workers 32 are required at the end-of-line conveyors 30 to keep pace with the printing press, which may output 50,000 to 75,000 mail pieces per hour. The first worker 32A at each end-of-line conveyors 30 identifies the bundle breaks and adjusts the shingled group of mail pieces 12 into a horizontally-stacked bundle formation before placing the mail pieces 12 into a tray 40. The next worker 32B applies straps 44 to each bundle 36, if required. The last worker 32C on each end-of-line conveyor 30 transports the mail trays 40 into a skid 48 for eventual transport away from the end-of-line conveyor 30. The skids 48 may be transported by another worker to a shipping dock for direct shipment out of the printing facility to a postal service facility, or to a sorting device within the printing facility where the bundles 36 of mail pieces 12 are commingled with mail pieces from other presses to achieve greater postal service discounts.

In addition to marking bundle and tray breaks, the controller-operated fingers 34 can also be used to identify certain mail pieces 12 for removal. These mail pieces 12 may be identified somewhere along the press as being defective or may be generated as sample pieces in a controlled "book pull" operation for the press operator to visually monitor quality control or for providing to the customer of the print job (i.e., the official sender of the mail pieces 12). However, any of the mail pieces 12 identified as defective or samples must still be manually separated from the mail stream and directed to a trash bin or special collection area by a worker 32.

Automated devices that mark bundle and tray breaks have been incorporated into off-press mail sorting systems, such as in-line inserters, which create a mail stream of mail pieces by discharging mail pieces (printed on and transported from multiple presses) from a series of hoppers. These systems generally operate under 25,000 pieces per hour, and the stream of mail pieces is a non-shingled stream (i.e., the individual mail pieces are spaced apart along the direction of conveyance). An example of such an off-line device is the Mailstream Productivity Series high-speed mail inserter available from Pitney Bowes. A controller that controls the discharge of the various mail pieces from the various hoppers to create mail groups for attaining postal discounts can also mark bundle and tray breaks for identification by a worker. For example, end-of-bundle and end-of-tray mail pieces can be marked with different colored ink in a predetermined inconspicuous location for identification by the worker. On the other hand, a physical offset can be created among a stack of mail pieces to identify bundle and tray breaks. In one offsetting method, the end-of-bundle and end-of-tray mail pieces are positioned alongside a uniform stack of mail pieces, but positioned to have an edge visible out of registration with the rest of the stack. In another offsetting method, an entire stack will have a registration edge offset from that of the next sequential stack formed by the stacker such that each different stack created corresponds to a predetermined batch (i.e., for a single bundle or a single tray).

SUMMARY

In one aspect, provided is a method that includes creating a stream of uniquely-printed mail pieces on a press by printing repetitive static content on printable material to create press-printed material and printing unique information on at least some of the press-printed material. The printing of unique information is carried out by a controller that controls at least one variable printer according to a data file of intended recipients. The stream of uniquely-printed mail pieces is conveyed in a shingled formation, and the stream of uniquely-printed mail pieces is converted on-press into a plurality of batches of stacked mail pieces in which each of the batches contains only mail pieces belonging to a common group. The on-press conversion includes conveying the stream of mail pieces in the shingled formation into a stacking device, stacking the mail pieces with the stacking device, and controlling via the controller the creation of batch separation points among the mail pieces according to the data file.

In another aspect, provided is a method that includes creating a stream of uniquely-addressed mail pieces on a web offset press by printing repetitive static content on consecutive sections of a web of printable material with a pair of press rollers, separating the sections of the web and printing unique address information on each section of the press-printed material. The unique address is printed by a variable printer according to a mail file of intended recipients. The stream of uniquely-addressed mail pieces is conveyed in a shingled formation. An on-press conversion of the stream of uniquely-addressed mail pieces into a plurality of batches of stacked mail pieces is performed, each batch containing only mail pieces belonging to a common mail delivery group. The on-press conversion includes controlling via the controller the creation of batch separation points among the mail pieces according to the mail file, conveying the stream of mail pieces in the shingled formation into a stacking device, and stacking the mail pieces with the stacking device.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
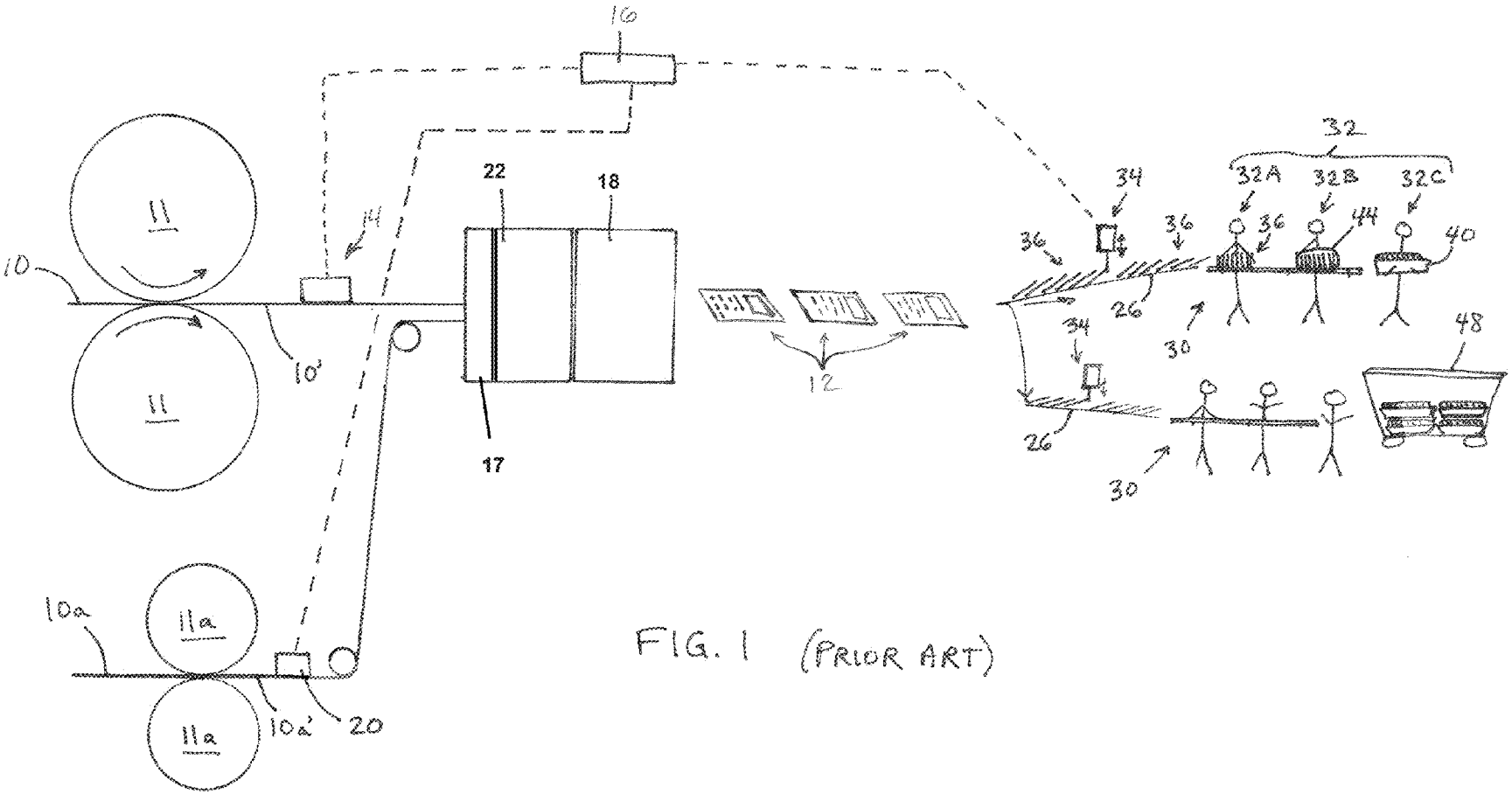
FIG. 1 (PRIOR ART)
FIG. 1 is a schematic view of a conventional print and sort operation on a printing press.
Figure 2:
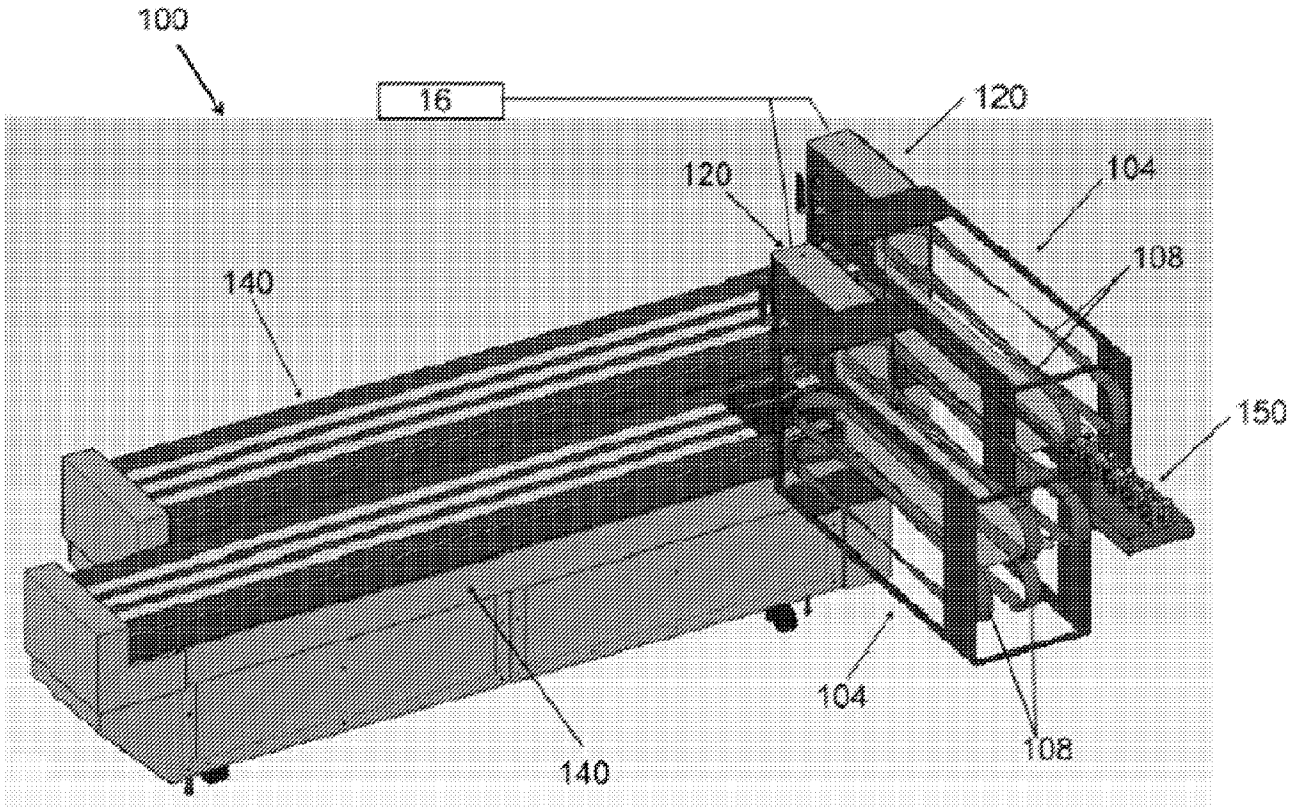
FIG. 2 is a perspective view of a pair of side-by-side end-of-press stackers for converting streams of shingled mail pieces into batches by mail groups.
Figure 3:
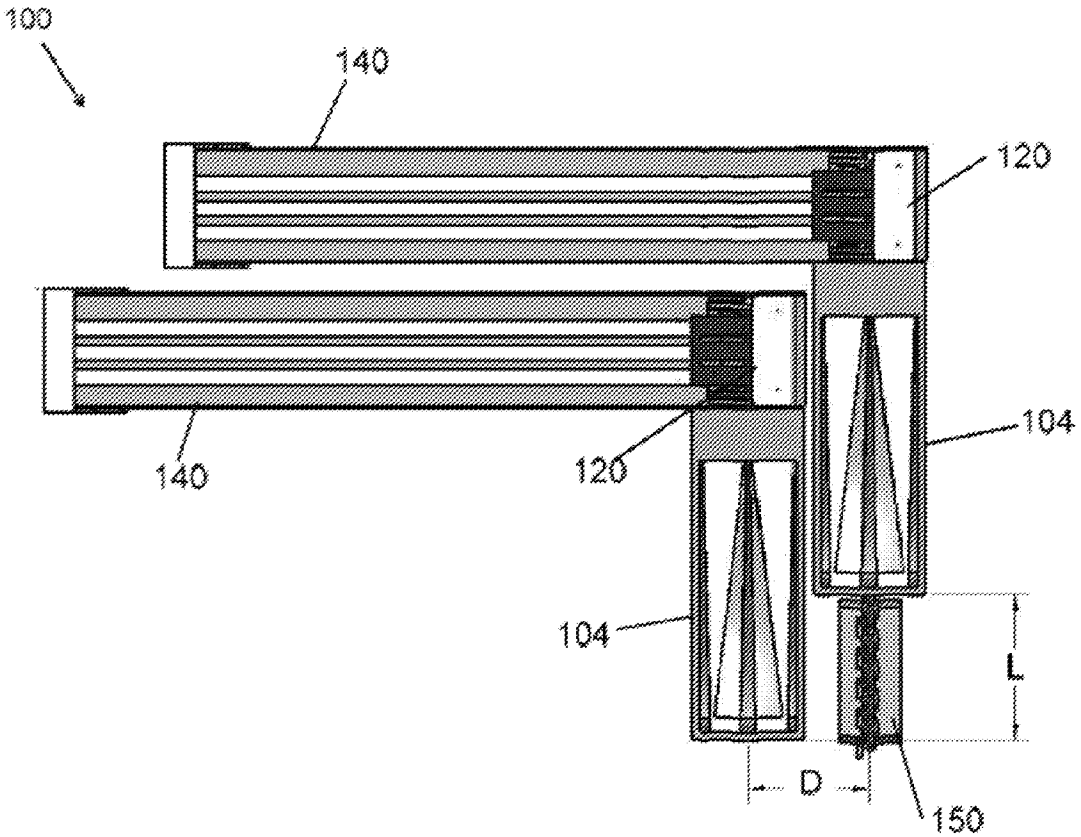
FIG. 3 is a top view of the pair of end-of-press stackers of FIG. 2.

FIGS. 2 and 3 illustrate one embodiment of a sorter system 100 for converting shingled streams of mail pieces into batches at the end of a press. The sorter system 100 can be used in place of the end-of-line conveyors 30 of FIG. 1 and allows the elimination of the pneumatic fingers 34 and at least some of the labor done by workers 32. As such, it should be understood that the sorter system 100 is used with a press, which operates as described with respect to FIG. 1 to generate one or more streams of shingled mail pieces 12 along one or more series of conveyors, which may be referred to as a delivery table(s) 26, and the description of the components and operation of the press need not be repeated from above. Because the sorter system 100 is positioned and configured to receive a continuous stream of mail pieces 12, at least a portion of each of which is printed as a web on the press, the sorter system 100 constitutes an "on-press" mail sorter. In other words, mail pieces 12 (or the web 10 from which they are produced) move along a continuous path through both the press and the sorter system 100, without being removed or stored, and by the time the mail pieces 12 leave the sorter system 100, they are sorted into batches by mail groups. Although the above description, which refers to elements of FIG. 1, focuses on an offset web press, the concept may be applied to different types of presses as well. These include flexographic, gravure, screen and variable or digital web and sheet-fed presses, such as inkjet presses and laser presses in which the content of the mail pieces 12 produced can be fully variable.

Figure 4:
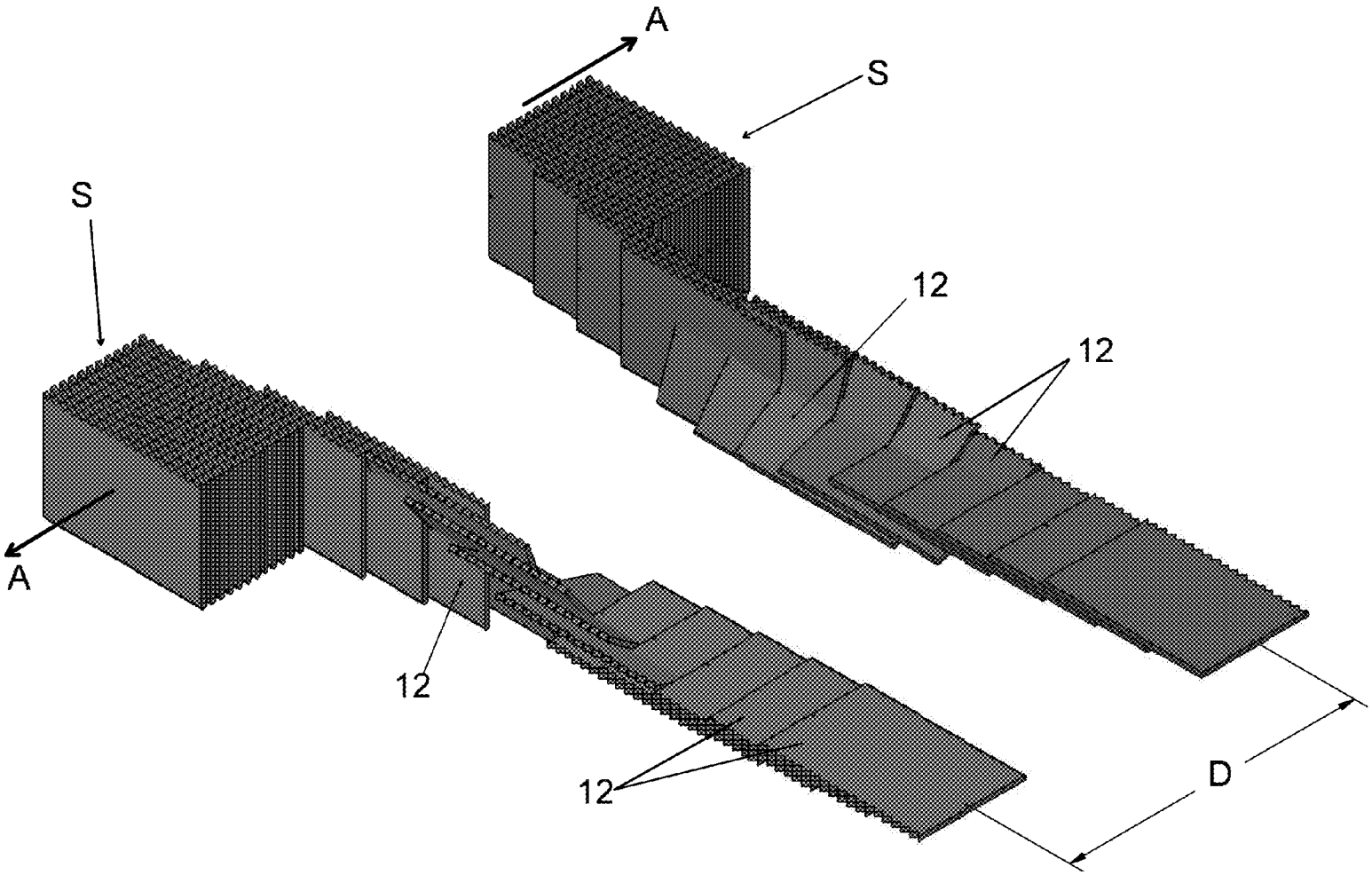
FIG. 4 is a perspective view showing two parallel shingled streams being flipped 90 degrees and stacked.

From the final conveyor of the delivery tables 26, each shingled stream of mail pieces 12 (either raw printed pieces or enveloped pieces) is delivered to a twist box 104 that twists the mail pieces 12 of each stream 90 degrees from a generally horizontal or flat orientation to an upright or vertical orientation. The twisting of the mail streams is illustrated in FIG. 4. In a construction such as that illustrated in which two shingled streams are conveyed side-by-side, the twist box 104 flips the outer edge of each stream upward so that the left stream (looking in the direction of conveyance) is twisted clockwise and the right stream is twisted counter-clockwise. This ensures that the mail pieces 12 are stacked with their interior edges (i.e., the edges of the mail pieces 12 that face each other when conveyed in shingled formation side-by-side) downward.

In one construction, the twist boxes 104 utilize 2-inch wide belts 108 that guide the 90-degree twisting of each stream of mail pieces 12. Each twist box 104 can accommodate up to an 8.5 inch wide mail piece 12, and the twist boxes 104 are positioned side-by-side with an on-center spacing distance D of less than 20 inches (e.g., about 16 inches). Each twist box 104 delivers its corresponding stream of mail pieces 12 to a stacking device 120. Because the close side-by-side proximity of the twist boxes 104 limits the accessibility for adjusting the relative height for proper delivery between each twist box 104 and the corresponding stacking device 120, each of the stacking devices 120 may be provided with motor-driven lifts (not shown) to provide height adjustment.

In order to have the batches of mail pieces 12 flow out of the two stacking devices 120 in parallel directions to side-by-side output tables 140, the overall length in the direction of conveyance from the end of the press delivery tables 26 to the stacking devices 120 is longer for one of the streams (i.e., one of the streams follows a longer "outer" run, while the other stream follows a shorter "inner" run). In order to keep the side-by-side press delivery tables 26 the same length and avoid the need to provide two different configurations of twist boxes 104 with different conveyance lengths, a transfer table 150 is provided adjacent the twist box 104 forming the longer "outer" run. In a construction having the twist boxes 104 spaced about 16 inches on-center, the length L of the transfer table 150 is about 19 inches.

To convert each stream of shingled mail pieces 12 into a plurality of batches of mail pieces, it is desirable to create batch separation points among the mail pieces 12. The batch separation points desirably should be created before the mail pieces 12 are outputted from the stacking devices 120 in stacks S as shown in FIG. 4, since the mail pieces 12 are difficult to precisely segregate once stacked. In the illustrated construction, the stacking devices 120 are preferably controlled by the controller 16 to create the batch separation points as the mail pieces 12 are stacked.

The operational stages of one embodiment of a stacking device 120 is shown in FIGS. 5-10. The belts 108 of the twist boxes 104 deliver the shingled streams, now turned so that the mail pieces 12 are standing upright, to a guide plate 124 of each stacking device 120. The guide plate 124 has a long, straight guide portion 124A to create a guide surface substantially perpendicular to the direction A of stack building. Extending from the upstream end of the guide portion 124A is an inlet portion 124B of the guide plate 124 that angles toward the stack building direction A as it approaches the guide portion 124A in so that each mail piece 12 is eased into parallel alignment to form the stack S. A pair of rollers 130, 132 are positioned adjacent the guide plate 124 or extend through apertures therein.

The first roller 130 encountered by the shingled stream of mail pieces 12 is a drive roller that is driven by a prime mover such as an electric motor (not shown). The drive roller 130 is primarily positioned to the non-working side of the guide plate 124, but extends to the working side by a small distance X1 (FIG. 5) that is about equal to the thickness of one of the mail pieces 12. The purpose of the drive roller 130 is to deliver each mail piece 12 to the second roller 132, which is an urge roller. Like the drive roller 130, the urge roller 132 is also positioned primarily to the non-working side of the guide plate 124, but extends a small distance X2 (FIG. 5) to the working side. The distance X2 may be greater than the distance X1, and about equal to the thickness of two mail pieces 12. When the urge roller 132 receives each sequential mail piece 12 from the drive roller 130, it urges the mail piece 12 (e.g., via an electric motor, not shown, drivingly coupled to the urge roller 132) into contact with a movable backstop 136. The backstop 136 is generally flat to guide a consistent edge E of the built stack S, and is movable back and forth parallel to the direction A of stack building as described in further detail below. Alternatively, the stacking device 120 may have a single roller or other configuration to move the mail pieces 12 into the stacking device 120.

Figure 5:
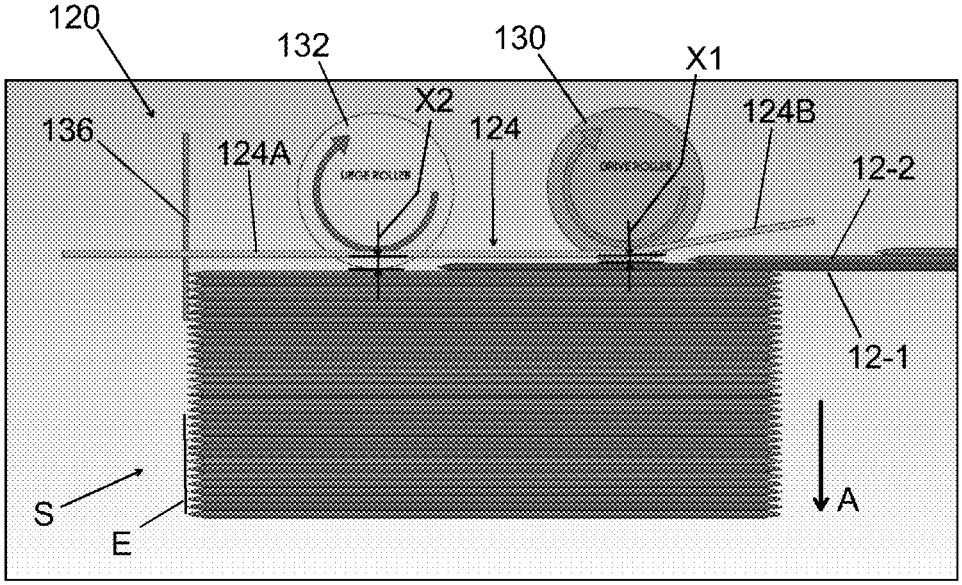
FIGS. 5-10 are top views of a stacking device, illustrating a stacking and offsetting process.
Figure 6:
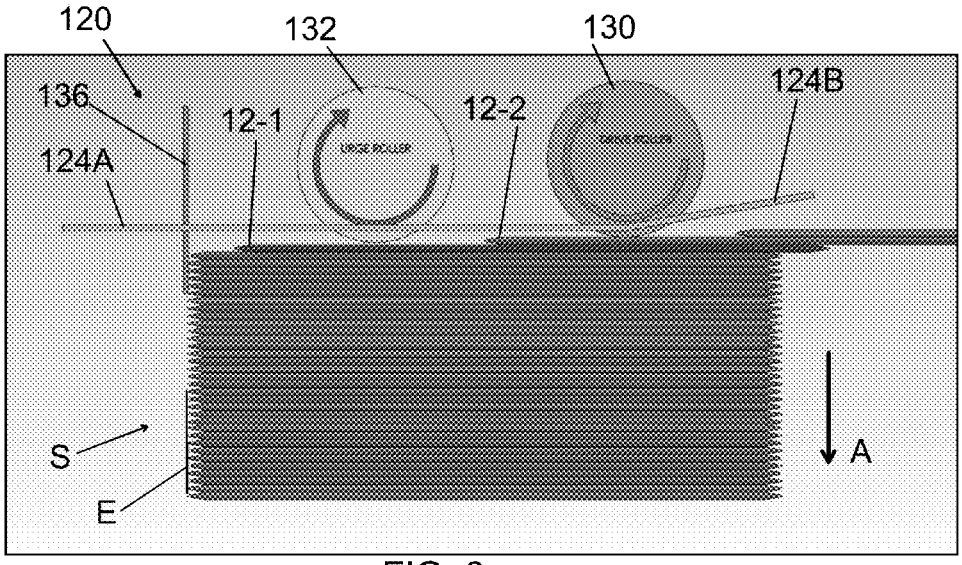

FIGS. 5-10 illustrate a shingled stream of enveloped mail pieces 12 being stacked and having batch separation points designated therein, at the time of stacking. To identify specific mail pieces 12 of the stream and the stack S, the reference characters 12-1 and 12-2 will be used with reference to these figures. As shown in FIG. 5, a stack S has already been created by the stacking device 120 by delivering each mail piece of the stream into contact with the backstop 136, which is extended to the working side of the guide plate 124 and positioned at a predetermined fixed distance from the urge roller 132 to define the stack edge E. However, mail piece 12-1 is designated by the mail file of the controller 16 to be the last mail piece 12 of the current stack S or the first mail piece 12 of the next sequential stack. According to one embodiment, this information is based on the addresses on the mail pieces 12. However, the mail pieces 12 may be placed or identified within common groups based on any other known criteria or attribute of either the intended recipients or the mail pieces 12 (e.g., geographic information such as country, state, county, city, regional, or zip code information, demographic information such as gender, race, age, income, marital status, etc., or characteristics of the mail pieces, such as word and/or graphic content, coloration, etc.). Alternatively, or in addition, batch separation points may be created for quality control review or pulling samples for customers as directed either automatically by the controller 16 or by direct input from a human operator. Alternatively, or in addition, the controller 16 or the human operator can direct the creation of batch separation points based on press information or status. For example, when sequential press rolls are spliced together, the areas of both rolls directly surrounding the splice are not suitable for creating finished mail pieces, and should be independently grouped for disposal. Any additional monitored information relating to the condition of the press may also be used to determine if other factors are present that will yield unusable mail pieces. It should be appreciated that the controller 16 is not limited to operation with a mail file and may work with any type of data file having requisite information for controlling the batching the mail pieces 12 or organizing mail pieces 12 into common groups. Furthermore, the mail pieces 12 may be uniquely-addressed for individual mailing, or may lack unique address printing and instead be configured for mailing as a group. In either case, the mail pieces 12 can be configured with any other type of unique (i.e., "variable") printing besides address that makes each individual mail piece 12 of the stream unique.

Figure 7:
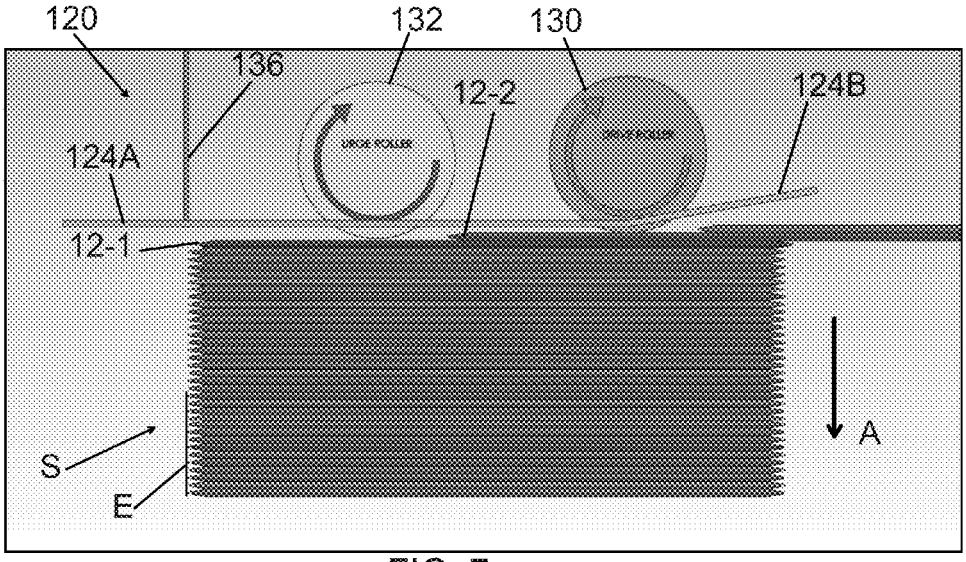
Figure 8:
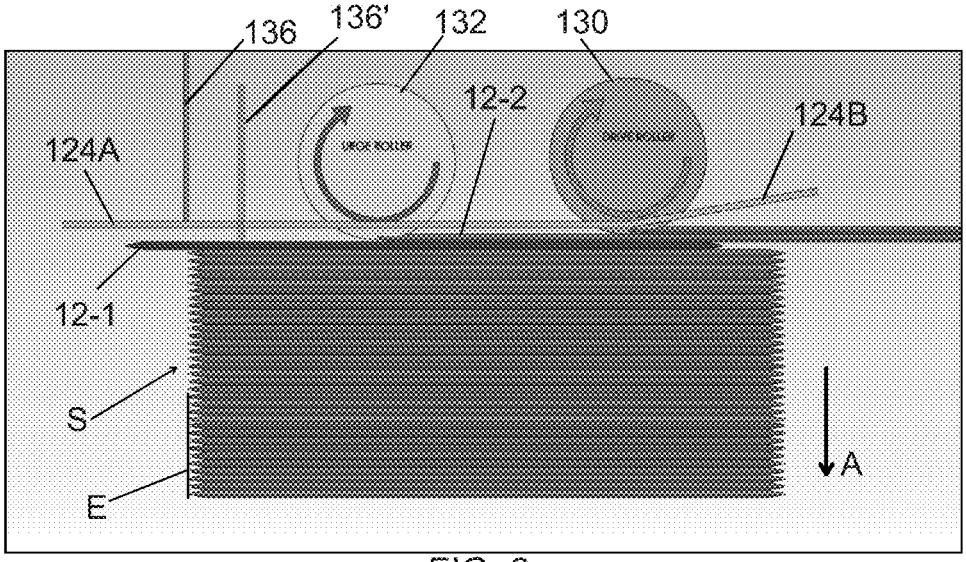
Figure 9:
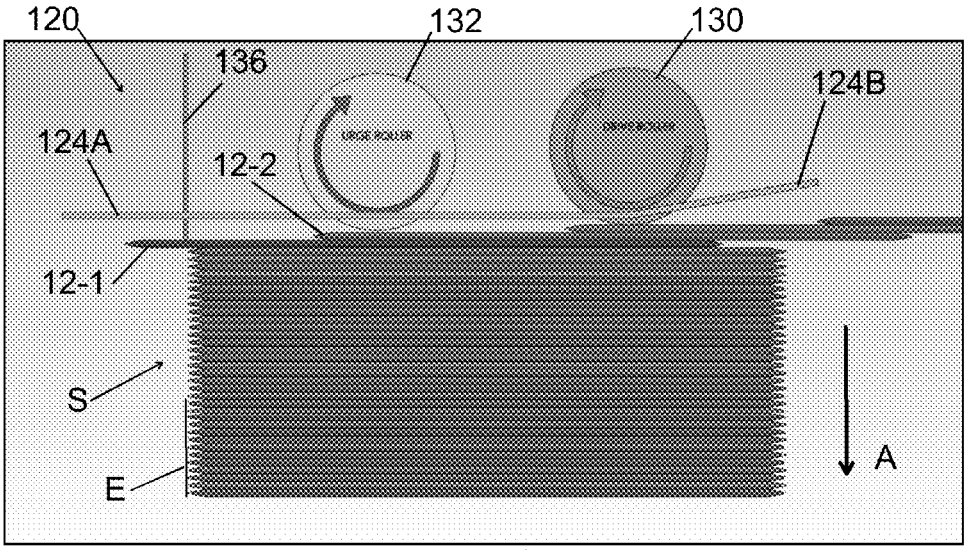
Figure 10:
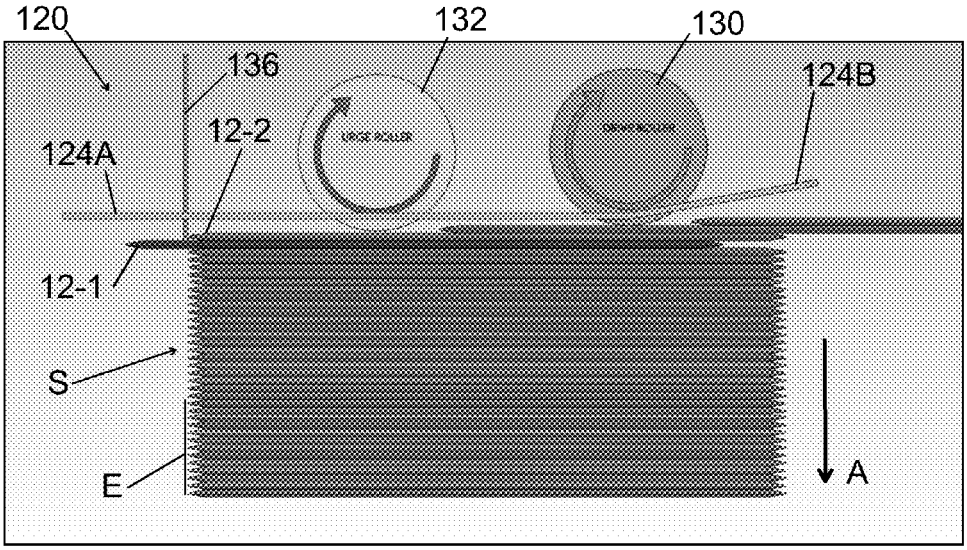

When separating batches by address information, the controller 16 directs operation of the stacking device 120 to segregate the mail pieces 12 into mail groups for postal discounts (e.g., by 3-digit zip code groups, 5-digit zip code groups, or carrier route order). Specifically, the controller 16 knows the place of the mail piece 12-1 within the shingled stream and, optionally, may receive a specific position signal from a sensor (not shown) when the leading edge of the mail piece 12-1 is detected at the stacking device 120. The position or detection of the mail piece 12-1 for creating the batch separation point may occur as the designated mail piece 12-1 is being delivered toward the backstop 136 by the urge roller 132. Based upon the known position of the mail piece 12-1, in one embodiment the controller 16 commands the backstop 136 to be retracted (FIG. 7) toward the non-working side of the guide plate 124 so that the urge roller 132 drives the specific mail piece 12-1 past the stack edge E to define the batch separation point (FIG. 8). The backstop 136 can be moved by any suitable mechanism, such as an electromechanical solenoid or pneumatic actuator. As soon as the designated mail piece 12-1 is offset from the stack edge E to define the batch separation point, the backstop 136 is returned to its normal working position on the working side of the guide plate 124, as shown in FIG. 9, prior to the delivery of the next-in-sequence mail piece 12-2 to the backstop 136. As shown in FIG. 10, the next-in-sequence mail piece 12-2 defines the beginning of the next stack. As described herein, the movable backstop 136, as controlled by the controller 16 in accordance with the mail file that determines the mail groups or a sensing element or a combination of both, creates an offset between the mail piece 12-1 and the remainder of adjacent mail pieces 12 that are stacked with a consistent edge E. The offset mail piece 12-1 serves as an identifier for physical separation of the stacks S into discrete batches. The stacking device 120 may also be provided with an automatic batch separator so that the output of the stacking device 120 can be discrete, spaced-apart batches of stacked mail pieces 12.

In an alternate construction, the backstop 136' can be located at a position that is on the side of the main stack edge E that is closer to the rollers 130, 132 as shown in FIG. 8. In this way, the batch separation point is created by stopping a particular mail piece short of the stack edge E rather than advancing it beyond the stack edge E.

As mentioned above, the offset mail piece 12-1 can ultimately be grouped with either the upstream or downstream group depending upon the predetermined protocol. Also, a system like that of U.S. Pat. No. 6,682,067, the entire contents of which are hereby incorporated by reference, that offsets all pieces of one batch from the adjacent batch may be utilized.

As described and illustrated, the stacking device 120 is a one-by-one or piece-by-piece basis device by which each sequential mail piece 12 is added sequentially to build the stack. This is in contrast to a worker who will grasp a shingled batch of mail pieces 12 and physically manipulate them into a stack formation all at once. By incorporating the stacking device 120 with piece-by-piece stacking ability to the end of the printing press, stacks are created more efficiently and fewer workers at the end of the press can easily keep up with typical press speeds.

In order to achieve one hundred percent (100%) mailing or near one hundred percent mailing (e.g., at or above a threshold such as 99.9 percent, 99.5 percent, or 99.0 percent) and enable the removal of defective mail pieces 12 and test mail pieces 12 for inspection and/or sample supplies to the print customer, an automatic diverter may be provided for singling out a predetermined mail piece 12 from the shingled stream and preventing it from being stacked with the other mail pieces 12. In some constructions, the diverted mail piece 12 may be automatically conveyed to a trash bin or special collection area away from the stacking area. For example, corresponding to the stacking method illustrated in FIGS. 5-10, a mail piece 12 may be diverted from the stack S by conveying the mail piece 12 completely past the stack S by driving the mail piece 12 an extended distance with the urge roller 132 with the backstop 136 retracted (FIGS. 7 and 8). The urge roller 132 may be used solely to drive the diverted mail piece 12 to an adjacent collection location. Alternatively, another conveyance device (e.g., conveyor belt, roller set, etc.) may receive the diverted mail piece 12 from the urge roller 132 and further transport the mail piece to a collection location. As mentioned above, this prevents the diverted mail piece 12 from being stacked with other mail pieces 12 and prevents the need for a worker to identify and remove the mail piece 12 which is not intended to be part of a mail group. Yet another example is that a single mail piece 12 or stack S of mail pieces 12 may be diverted downstream of the stacking device 120 either to a bin or other conveying device, or alternately, one or more mail pieces 12 can be prevented from initially joining the shingled stack by diverting the one or more identified mail pieces 12 at or before the point where the shingled stream is created at the end of the press.

Other methods for diverting specific mail pieces 12 from a shingled stream are also contemplated, and these can be utilized with the stacking device 120 of FIGS. 2, 3, and 5-10 or another type of stacking device.

Figure 12:
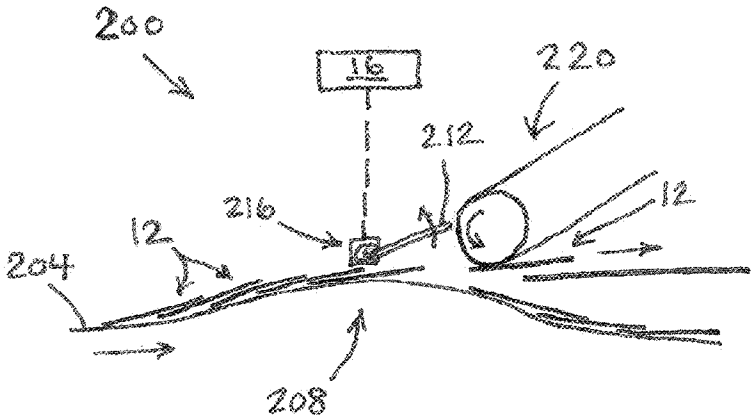
FIG. 12 is a side view of the diverter system of FIG. 11, diverting a mail piece.
Figure 11:
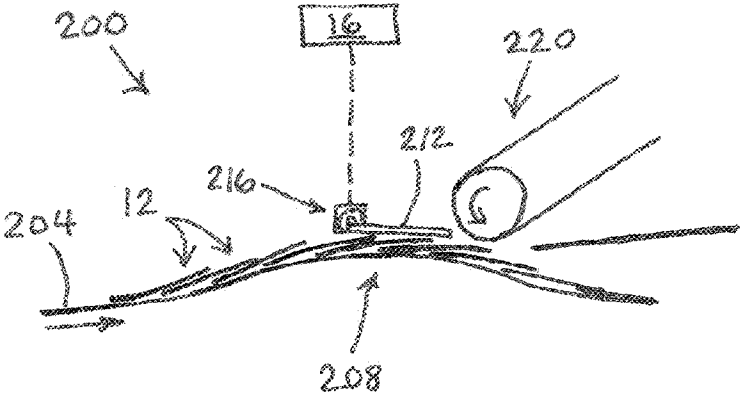
FIG. 11 is a side view of a diverter system for a stream of shingled mail pieces.

In one embodiment, a first alternate diverter 200 and method of diverting specific mail pieces 12 from a shingled stream are illustrated in FIGS. 11-12. During normal (non-divert) operation as shown in FIG. 11, the shingled stream is transported along a conveyor 204 over a hump 208 (i.e., an area of the conveyor 204 that upsets the linear conveyance of the mail pieces 12 in a direction A1 substantially perpendicular to the support surface of the conveyor 204 upstream of the area 208). As the shingled mail pieces 12 transition over the non-linear area or hump 208, a movable divert gate 212 ensures that the mail pieces 12 follow the downstream side of the hump 208, against the natural urge for each mail piece 12 to maintain its planar shape, which would cause the leading edge of each mail piece 12 to diverge significantly from the conveyor 204. When the controller 16 identifies a mail piece 12 that is not to be stacked with other mail pieces 12 in a mail group (e.g., a defective or sample piece), the controller 16 sends a signal to an actuator 216 (e.g., electric servo motor, pneumatic piston cylinder, etc.) of the divert gate 212 to move the divert gate 212 to a divert position (FIG. 12). In the divert position, the divert gate 212 allows the mail piece(s) specifically-identified by the controller 16 to be plucked from the shingled stream by an extractor. In the illustrated construction, the extractor may include at least one conveyor 220 operated at a speed in excess of the speed of conveyance of the shingled stream along the main conveyor 204. Without the divert gate 212 positioned to force the mail piece(s) to follow the hump 208, the leading edge of each mail piece(s) can lift away from the main conveyor 204 slightly, an amount sufficient to contact the faster extraction conveyor 220, which then pulls the mail piece(s) 12 out of the shingled stream. This allows the diverted mail piece(s) to be conveyed by the extraction conveyor 220 and/or an additional transport mechanism to a trash bin or special collection area.

Figure 13:
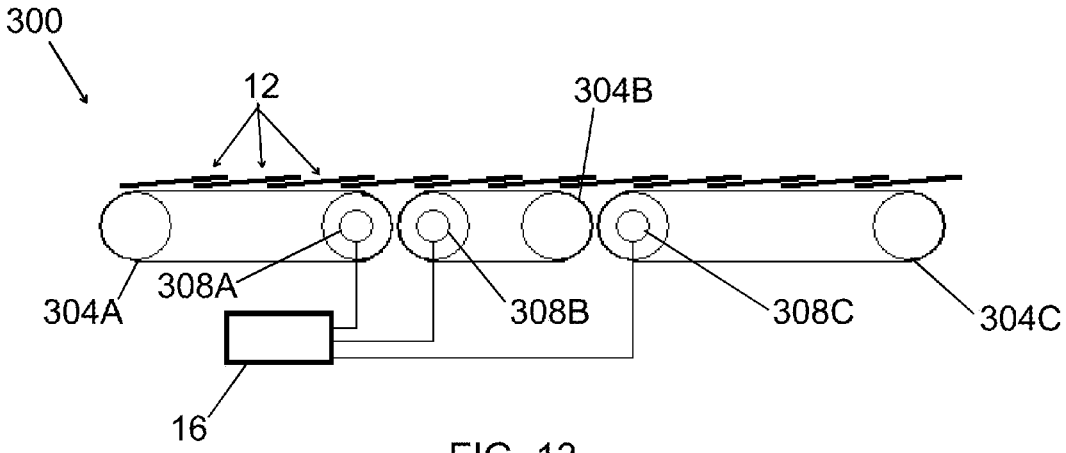
FIG. 13 is a side view of a multiple conveyor system for conveying a stream of shingled mail pieces.
Figure 14:
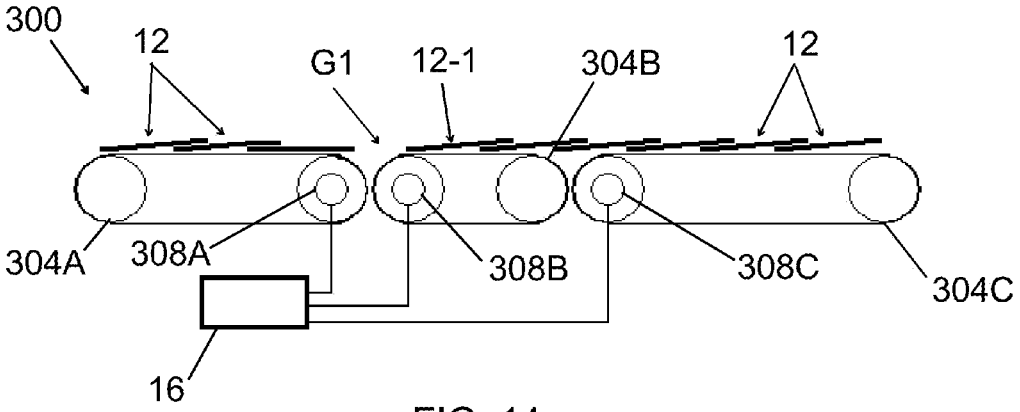
FIG. 14 is a side view of the multiple conveyor system of FIG. 13, creating a first separation along the stream of mail pieces.
Figure 15:
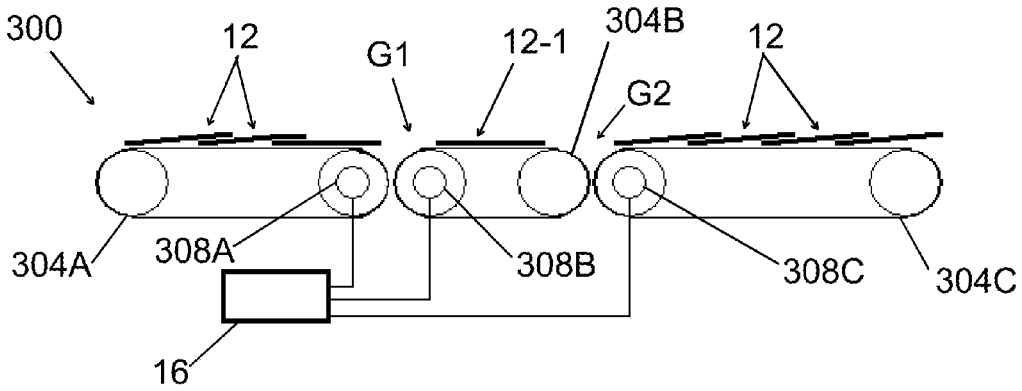
FIG. 15 is a side view of the multiple conveyor system of FIG. 13, creating a second separation along the stream of mail pieces to single out a particular mail piece.

FIGS. 13-15 illustrate another alternate diverter 300 and method of diverting specific mail pieces 12 from a shingled stream. The diverter 300 of FIGS. 13-15 includes three conveyors 304A-C that are independently drivable at different speeds. In the illustrated construction, each conveyor 304A-C is driven by a separate motor 308A-C, all of which are controlled by the controller 16 which keeps track of the mail groups and selected sample mail pieces 12 for diversion. Under normal (non-divert) operation as shown in FIG. 13, the shingled stream is transported along all three conveyors 304A-C, all of which are driven at substantially the same speed. However, using the controller 16 to command a temporary net acceleration from the first conveyor 304A to the second conveyor 304B can introduce a first gap G1 (FIG. 14) behind a mail piece 12-1 designated for diversion. Likewise, the controller 16 can command a temporary net acceleration from the second conveyor 304B to the third conveyor 304C to introduce a second gap G2 (FIG. 15) in front of the mail piece 12-1. Once singled out from the shingled stream, the designated mail piece 12-1 can easily be re-directed to a location away from the stacking location (e.g., via a lateral pusher onto an alternate conveyor, a suction removal tool, selectively repositioning one of the conveyors from a first position to a second position, or other means). Although the process is described as first creating the gap G1 behind the to-be-diverted piece 12-1 and subsequently creating the gap G2 in front of the to-be-diverted piece 12-1, the conveyors 304A-C can be used to effect the necessary gaps G1, G2 in the opposite sequence, and in some cases, more of fewer than three conveyors 304A-C may be used. For example, each gap G1, G2 may be effected over a series of sequential conveyor transfers rather than a single transfer.

Figure 17:
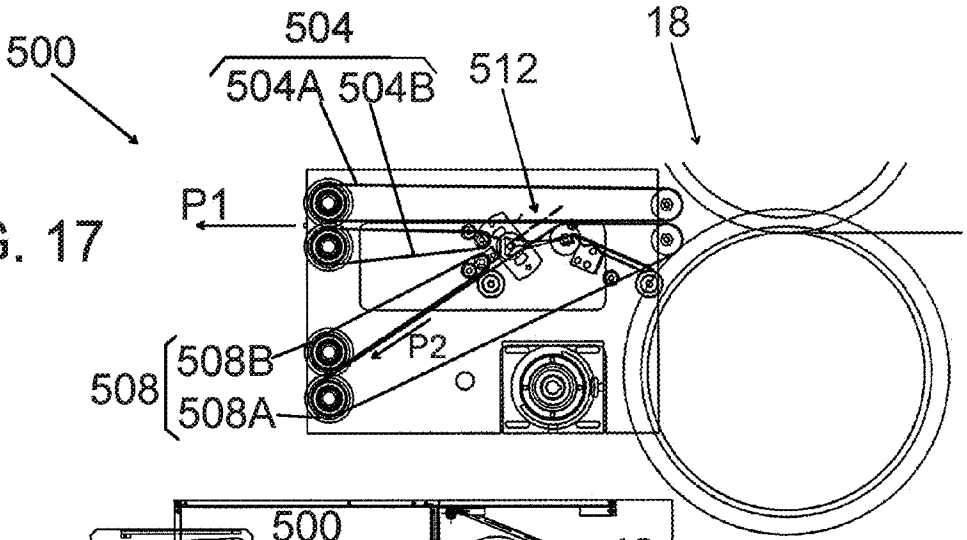
FIG. 17 is a detail view of the diverter device of FIG. 16.
Figure 16:
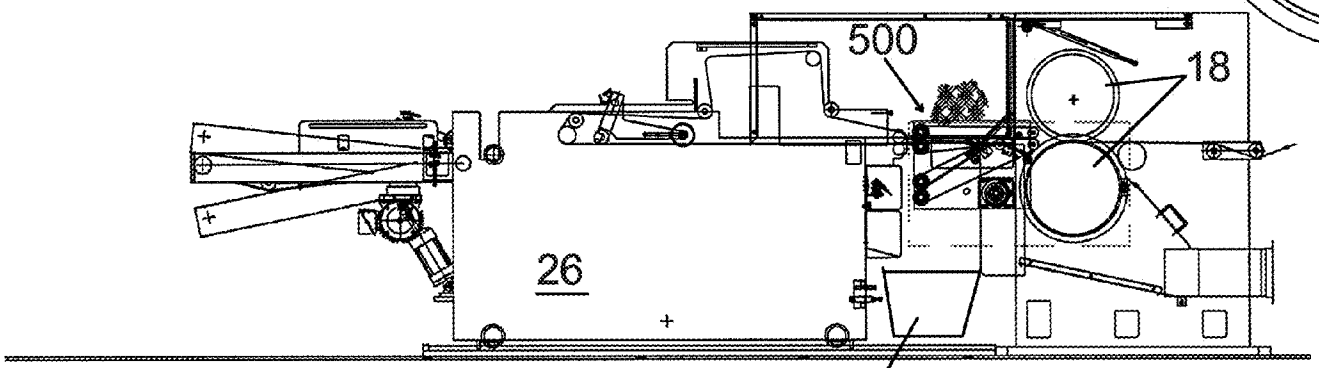
FIG. 16 is a side view of a diverter device incorporated into the end of a press.

FIGS. 16 and 17 illustrate another alternate diverter 500 and method of diverting specific mail pieces 12 from a shingled stream. The diverter 500 of FIGS. 16 and 17 is incorporated into the end of the press between the cutter unit 18 (e.g., rotary cutter) and the delivery table 26. The diverter 500 includes a first set of conveyors 504 defining a first conveyance path P1 and a second set of conveyors 508 defining a second conveyance path P2 The mail pieces 12 are initially conveyed from the cutter unit 18 by a first one of the conveyors 504A of the first set 504 and a first one of the conveyors 508A of the second set 508. In the illustrated construction, the conveyors 504A, 508A that initially convey the mail pieces 12 from the cutter unit 18 are the outermost conveyors of the diverter 500. These outermost conveyors 504A, 508A transport the mail pieces 12 to a position where the upstream ends of both of the other two conveyors 504B, 508B are located alongside each other. A divert gate or "flapper" 512 is positioned at this location, and is operated by a rotary solenoid or other mechanism to move between a first position and a second position (shown dashed in FIG. 17). In the first position, the flapper 512 is down, allowing the mail pieces to be conveyed along the first conveyance path P1 by the conveyors 504A, 504B of the first set. When moved to the second position, as controlled by the controller 16, the flapper 512 blocks the mail pieces 12 from the first conveyance path P1, and instead directs the mail pieces 12 to the second conveyance path P2 defined by the conveyors 508A, 508B of the second set. Such a diverter 500 may be available from Siemens Energy & Automation, Inc., and may utilize a Ledex rotary solenoid available from Johnson Electric. The diverted mail pieces 12 can be directed to a bin 518 or other collection device for collection or disposal, depending on the reason for diversion. It should be noted that multiple diverters 500 may be placed in series to divert various mail pieces 12 to multiple different locations along the press. For example a second diverter 500 can be located downstream of the illustrated diverter 500 to receive mail pieces from the first conveyance path P1 and selectively divert additional mail pieces to a second bin 518. Alternatively, or in addition, another diverter 500 can be located downstream of the second conveyance path P2 of the illustrated diverter 500 to further separate the diverted mail pieces 12.

Figure 18:
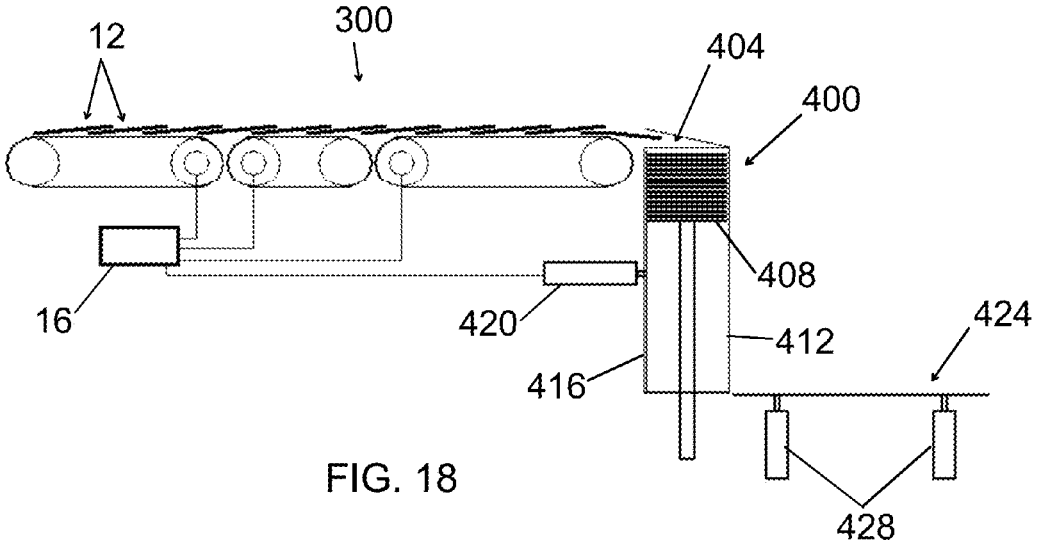
FIG. 18 is a side view of vertical stacking device creating a stack of mail pieces from a shingled stream of mail pieces.
Figure 19:
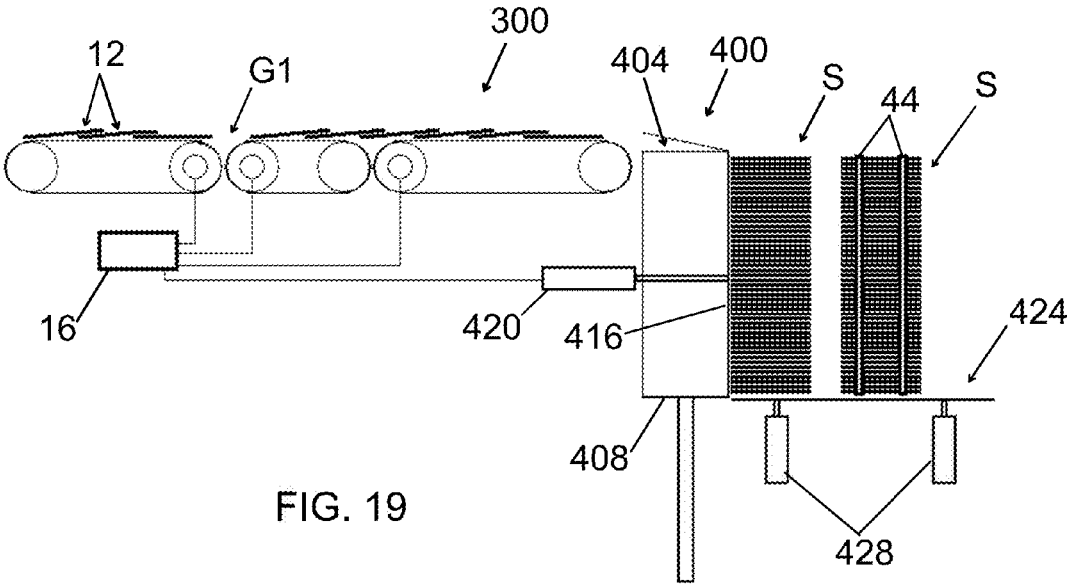
FIG. 19 is a side view of the vertical stacking device of FIG. 16, showing both strapped and un-strapped stacks ejected from the stacking device.

FIGS. 18 and 19 illustrate an alternate stacking device 400 that stacks mail pieces 12 vertically rather than horizontally as shown in FIGS. 2-10. The stacking device 400 is illustrated as receiving mail pieces 12 from the diverter 300 of FIGS. 13-15. Although it is advantageous to provide a diverter upstream of the stacking device 400, the shingled stream of mail pieces 12 may be conveyed indirectly rather than directly from a diverter. Regardless of the specific arrangement of parts, the stacking device 400 is provided at the end of a printing press to constitute an end-of-press sorter system. In the illustrated construction, the speed-independent conveyors 304A-C of the diverter 300 are utilized, as commanded by the controller 16, to create gaps G1 (FIG. 19), or "batch separation points," identifying bundle and tray breaks among the mail pieces 12, but other manners of creating bundle and tray breaks such as those described above may also be used in conjunction with the stacking device 400.

The vertical stacking device 400 includes an open top 404 and a vertically-movable support or pedestal 408 for receiving the mail pieces 12. A rear wall 412, or a portion thereof, serves as a temporary backstop that can be selectively released to allow ejection of a stack S as shown in FIG. 19. A front wall 416 (adjacent the supply side) is movable in the horizontal direction by an actuator 420, which is coupled to the controller 16 to receive a signal therefrom, to eject a stack S as shown in FIG. 19 when commanded by the controller 16. The actuator 420 can be any suitable type of actuator (e.g., electric, hydraulic, pneumatic). The stacking device 400 can be used to create uniform full-height stacks S as shown in FIG. 19, but can also be used to create any size stack up to a full-height stack S. The stacks S of mail pieces 12, regardless of their finished height, can be banded with straps 44 within the stacking device 400 or on the adjacent delivery table 424 to which the stacks S are moved from the stacking device 400. When shorter than full-height stacks are ejected from the stacking device 400, the pedestal 408 is moved to the bottom or home position to deliver the stack to the height at which the delivery table 424 is located. However, the delivery table 424 may be provided with adjustable height legs 428 and may be moved upward to receive partial height stacks. Since the stacking device 400 outputs each stack S individually (i.e., discrete, spaced-apart batches of stacked mail pieces 12), it is considered to be an automatic batch separator as well as a stacker. However, the stacking device 400 can alternately be operated to create only full-height stacks S, with batch separation points marked within an individual stack S, if necessary. This can be accomplished by marking one or more mail pieces 12 (e.g., with ink) prior to stacking, or by utilizing a movable backstop to offset one or more mail pieces 12 as described above, among other means.

As described and illustrated, the stacking device 400 is a one-by-one or piece-by-piece basis by which each sequential mail piece 12 is added sequentially to build the stack. This is in contrast to a worker who will grasp a shingled batch of mail pieces 12 and physically manipulate them into a stack formation all at once. By incorporating the stacking device 400 with piece-by-piece stacking ability to the end of the printing press, stacks are created more efficiently and fewer workers at the end of the press can easily keep up with typical press speeds.

Regardless of which on-press sorting system is used to create batches of stacked mail pieces 12, the batches from one printing press may be transported to a commingler, which receives the batches of stacked mail pieces 12, along with batches of stacked mail pieces from one or more alternate printing presses. Each particular batch from any of the presses contains only mail pieces belonging to a particular mail delivery group as described above. At the commingler, the batches of mail pieces from the multiple presses are commingled into integrated batches of mail pieces, each integrated batch containing mail pieces from various presses, all belonging to a common mail delivery group to achieve greater postal discounts. The controller that controls the commingler, may be the controller 16 that controls the printing occurring on one or more presses that provide mail pieces to the commingler, or may be a separate controller operable to receive the requisite information in the form of a data file for properly commingling the mail pieces. Regardless of whether the commingler controller is a master controller for multiple presses or a standalone controller for the commingler, the controller has custody of each mail piece or batch from each press to deliver the mail pieces or batches to the desired location within the commingler.

Various features and advantages of the invention are set forth in the following claims.

What is claimed is:

1. A method comprising:

creating a stream of uniquely-addressed mail pieces on a web offset press by printing repetitive static content on consecutive sections of a web of printable material with a pair of press rollers, printing unique address information on each section of the press-printed material, and separating the sections of the web, the printing of unique address information being carried out by controlling at least one variable printer according to a mail file of intended recipients;

conveying the stream of uniquely-addressed mail pieces in a shingled formation; and performing an on-press conversion of the stream of uniquely-addressed mail pieces into a plurality of batches of stacked mail pieces in which each of the batches contains only mail pieces belonging to a common mail delivery group, the on-press conversion including:

controlling via a controller the creation of batch separation points among the mail pieces according to the mail file, conveying the stream of mail pieces in the shingled formation directly into a backstop of a stacking device, and stacking the mail pieces with the stacking device by sequentially stopping the movement, in the direction of conveyance, of each mail piece at the backstop to form the mail pieces into a stack, piece-by-piece, in a direction perpendicular to the direction of conveyance.

2. The method of claim 1, wherein the batch separation points are created as the mail pieces are stacked.

3. The method of claim 1, wherein the batch separation points are created before the mail pieces are conveyed into the stacking device.

4. The method of claim 1, further comprising providing the batches of stacked mail pieces to a commingler along with additional batches of stacked mail pieces printed on another press; and operating the commingler to build integrated batches of mail pieces from the different presses, each integrated batch including only mail pieces belonging to a common mail delivery group.

5. The method of claim 1, further comprising splitting the stream of uniquely-addressed mail pieces into multiple streams, and converting the multiple streams into pluralities of batches of stacked mail pieces in a pair of side-by-side end-of-press stacking devices.

6. The method of claim 5, further comprising conveying the multiple streams on parallel conveyors spaced less than 20 inches apart on-center.

7. The method of claim 1, further comprising identifying at least one specific mail piece among the stream of mail pieces and diverting the at least one specific mail piece to a collection location away from the stacking device.

8. The method of claim 7, wherein the at least one specific mail piece is identified as being at least one of a defective mail piece and a sample piece.

9. The method of claim 7, wherein diverting the at least one specific mail piece comprises diverting the specific mail piece at the stacking device.

10. The method of claim 7, wherein diverting the at least one specific mail piece comprises diverting the specific mail piece prior to reaching the stacking device.

11. The method of claim 7, further comprising locally de-shingling the stream of mail pieces to single out the at least one specific mail piece from the stream prior to diverting the at least one specific mail piece.

12. The method of claim 1, wherein printing unique address information on each section of the press-printed material with the at least one variable printer includes printing with a digitally controlled printer.

13. The method of claim 1, wherein the uniquely-addressed mail pieces are enveloped mail pieces built on-press comprising an insert and an envelope.

14. The method of claim 13, further comprising printing the envelopes on press by conveying a second printable material through the press.

15. A method comprising:

creating a stream of uniquely-addressed mail pieces on a web offset press by printing repetitive static content on consecutive sections of a web of printable material with a pair of press rollers, printing unique address information on each section of the press-printed material, and separating the sections of the web, the printing of unique address information being carried out by controlling at least one variable printer according to a mail file of intended recipients;

conveying the stream of uniquely-addressed mail pieces in a shingled formation; and performing an on-press conversion of the stream of uniquely-addressed mail pieces into a plurality of batches of stacked mail pieces in which each of the batches contains only mail pieces belonging to a common mail delivery group, the on-press conversion including:

conveying the stream of mail pieces in the shingled formation into a stacking device, stacking the mail pieces with the stacking device, and creating batch separation points according to the mail file as the mail pieces are stacked, without separating the mail pieces from the shingled stream prior to stacking.

16. The method of claim 15, wherein the mail pieces are stacked piece-by-piece in the stacking device, in a direction perpendicular to the direction of conveyance.

17. The method of claim 15, further comprising identifying at least one specific mail piece among the stream of mail pieces and diverting the at least one specific mail piece to a collection location away from the stacking device, wherein the at least one specific mail piece is identified as being at least one of a defective mail piece and a sample piece.

18. The method of claim 17, wherein diverting the at least one specific mail piece comprises diverting the specific mail piece at the stacking device.

19. The method of claim 15, further comprising splitting the stream of uniquely-addressed mail pieces into multiple streams, and converting the multiple streams into pluralities of batches of stacked mail pieces in a pair of side-by-side end-of-press stacking devices.

20. The method of claim 15, further comprising providing the batches of stacked mail pieces to a commingler along with additional batches of stacked mail pieces printed on another press; and operating the commingler to build integrated batches of mail pieces from the different presses, each integrated batch including only mail pieces belonging to a common mail delivery group.

* * * * *